US011559112B2

(12) United States Patent
Clements

(10) Patent No.: US 11,559,112 B2
(45) Date of Patent: Jan. 24, 2023

(54) BELT BUCKLE WITH REPLACEABLE INSERT

(71) Applicant: Allyn Gerald Clements, Frederick, MD (US)

(72) Inventor: Allyn Gerald Clements, Frederick, MD (US)

( * ) Notice: Subject to any disclaimer, the term of this patent is extended or adjusted under 35 U.S.C. 154(b) by 236 days.

(21) Appl. No.: 16/931,634

(22) Filed: Jul. 17, 2020

(65) Prior Publication Data

US 2022/0015510 A1 Jan. 20, 2022

(51) Int. Cl.
*A44B 11/00* (2006.01)

(52) U.S. Cl.
CPC ..... *A44B 11/001* (2013.01)

(58) Field of Classification Search
CPC ..... A44B 11/001; A44B 11/22; A44B 11/226; A44B 11/258
See application file for complete search history.

(56) References Cited

U.S. PATENT DOCUMENTS 4,052,773 A * 10/1977 Nesbitt ..... A44B 11/001 40/640
4,691,460 A * 9/1987 Kohl ..... G09F 7/02 40/640
4,959,890 A * 10/1990 Pazurek ..... A44B 1/14 63/29.1
5,282,297 A * 2/1994 Angus ..... A44B 11/001 24/163 K
5,379,493 A * 1/1995 Wu ..... A44B 11/001 24/163 K
5,526,551 A * 6/1996 Herman ..... A44C 17/02 24/712.1
5,548,878 A * 8/1996 Romagnoli ..... A44B 11/258 24/442
5,630,258 A * 5/1997 Schneider ..... A44B 11/258 24/303
5,979,019 A * 11/1999 Johnson ..... A44B 11/001 24/3.12
6,098,252 A * 8/2000 Woerth, Jr. ..... G09F 23/00 24/163 K
6,182,388 B1 * 2/2001 Patton ..... G09F 23/00 40/640
8,794,682 B2 * 8/2014 Fiedler ..... A45C 13/1069 24/303
2010/0283269 A1 * 11/2010 Fiedler ..... A44B 11/258 292/251.5
2013/0174383 A1 * 7/2013 Anderson ..... A44B 11/22 24/186
2014/0259303 A1 * 9/2014 Eliason ..... A44B 11/001 2/338
2015/0327631 A1 * 11/2015 Kaneko ..... A44B 11/266 24/665
2017/0245600 A1 * 8/2017 Ozburn ..... A44C 25/004

* cited by examiner

*Primary Examiner* — David M Upchurch
(74) *Attorney, Agent, or Firm* — Baker Botts L.L.P.

(57) ABSTRACT

A belt buckle with a replaceable insert is provided. The belt buckle includes a top cover, a bottom plate, a replaceable insert, and a base plate. The top cover includes a first recess. The bottom plate includes a first extruded portion extruding toward the top cover. The replaceable insert includes a second recess. The replaceable insert is disposed at least in part between the top cover and the bottom plate. The first extruded portion is disposed at least in part in the second recess.

18 Claims, 7 Drawing Sheets

BELT BUCKLE WITH REPLACEABLE INSERT

FIELD

The present invention relates to a belt buckle or belt and relates more particularly to such a belt buckle or belt having a replaceable insert.

BACKGROUND

Belt buckles are well known. Belts have been widely used to support pants or other articles of clothing. In addition to a utilitarian purpose, belts may also be decorative and worn according to current fashion.

Belts or belt buckles of different designs or colors may be used to match pants of different designs or colors. However, it is not economic to purchase various belts or belt buckles in order to match pants of different designs or colors.

SUMMARY OF THE INVENTION

In view of this background, it is an objective of the present invention to provide new belt buckles or belts that provide different designs without the need for purchasing multiple belt buckles or belts. This and other objects are achieved by belt buckles or belts with a replaceable insert in accordance with embodiments of the invention.

In accordance with one aspect of the present invention, a belt buckle includes a top cover, a bottom plate, and a replaceable insert. The top cover includes a first recess. The bottom plate includes a first extruded portion extruding toward the top cover. The replaceable insert includes a second recess. The replaceable insert is disposed at least in part between the top cover and the bottom plate. The first extruded portion is disposed at least in part in the second recess.

In accordance with another aspect of the present invention, a belt buckle includes a top cover, a bottom plate, and a replaceable insert. The top cover includes a first recess. The bottom plate includes a first extruded portion extruding toward the top cover. The replaceable insert includes a second recess. The replaceable insert is disposed at least in part between the top cover and the bottom plate. The top cover, the bottom plate, and the replaceable insert are formed as mutually corresponding shapes to form a 3-dimensional shape of the belt buckle.

DETAILED DESCRIPTION

The following detailed description includes references to the accompanying figures. In the figures, similar symbols typically identify similar components, unless context dictates otherwise. The example embodiments described herein are not meant to be limiting. Other embodiments may be utilized, and other changes may be made, without departing from the scope of the subject matter presented herein. It will be readily understood that the aspects of the present disclosure, as generally described herein and illustrated in the figures can be arranged, substituted, combined, separated, and designed in a wide variety of different configurations, all of which are contemplated herein.

Figure 1:
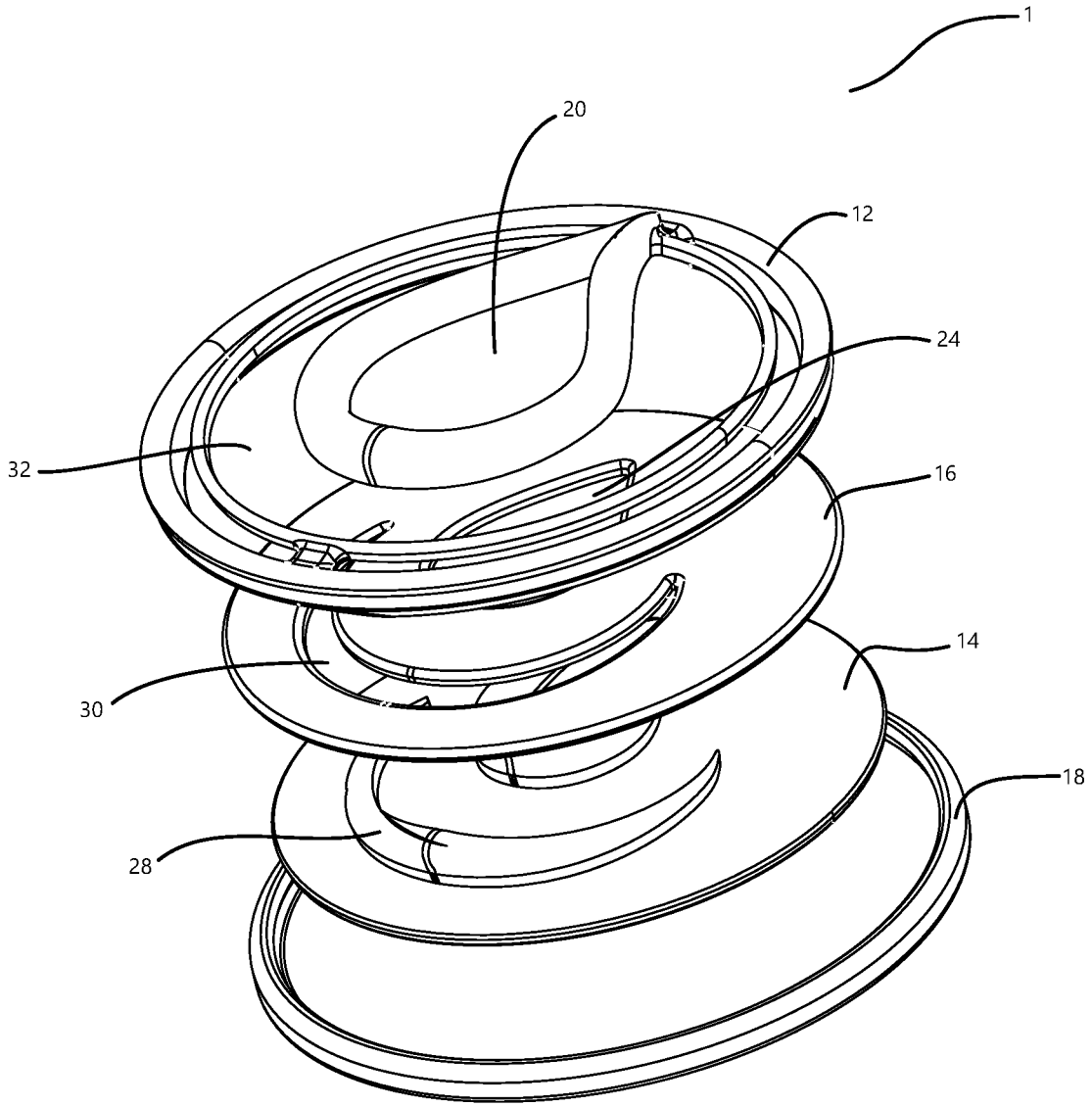
FIG. 1 is an exploded perspective view of a belt buckle in accordance with a first exemplary embodiment of the present invention.
Figure 2:
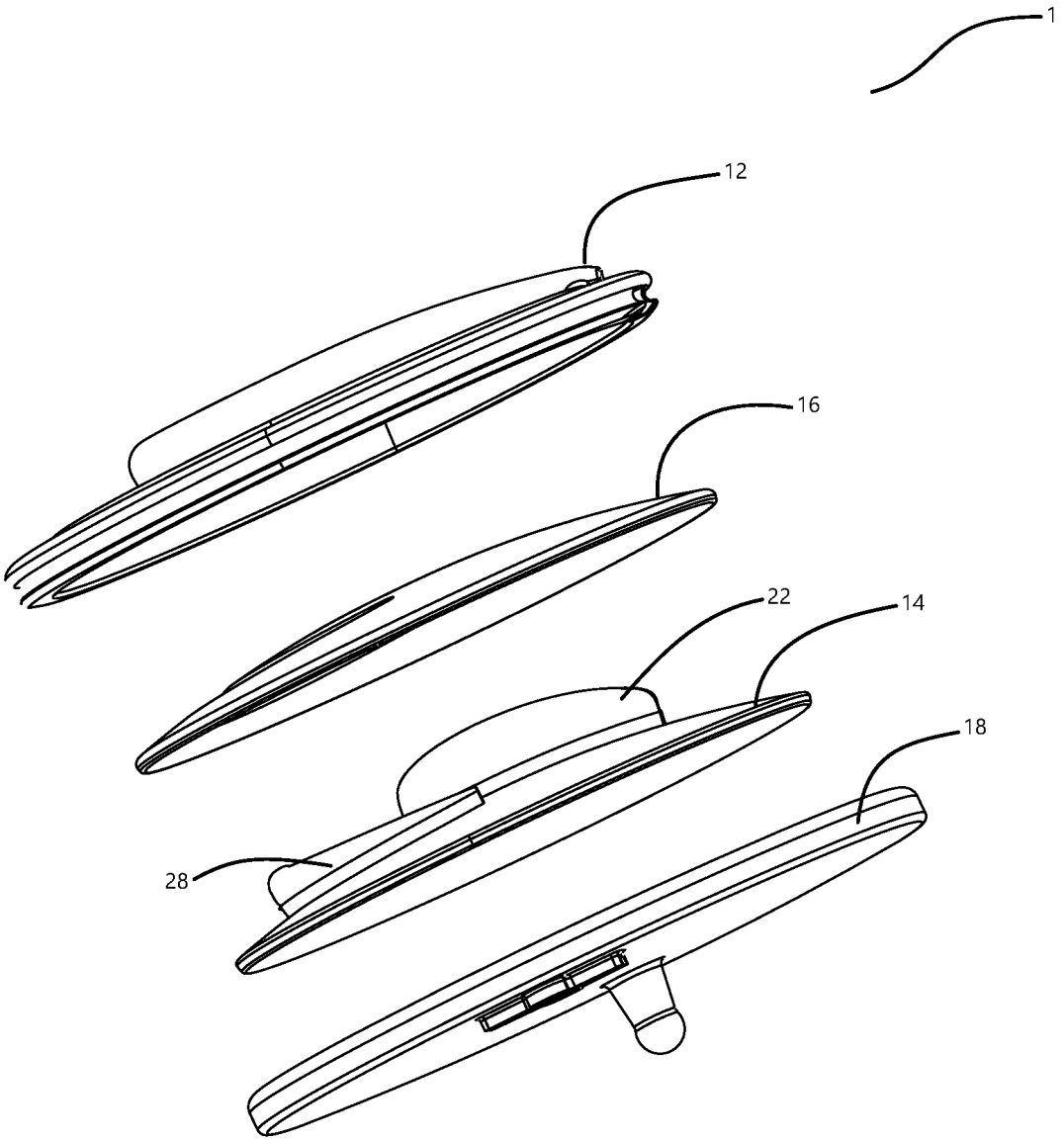
FIG. 2 is an exploded side view of the belt buckle in accordance with the first exemplary embodiment of the present invention.
Figure 3:
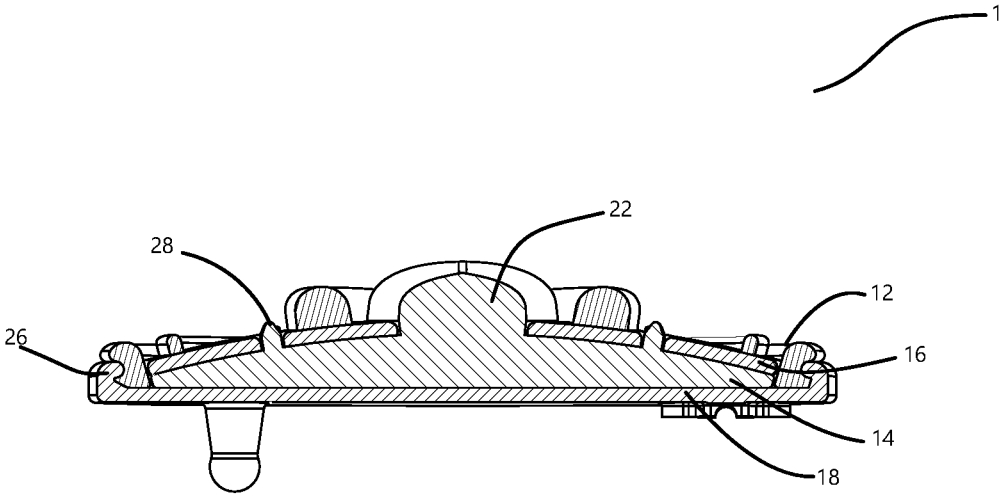
FIG. 3 is a sectional side view of the belt buckle in accordance with the first exemplary embodiment of the present invention.
Figure 4:
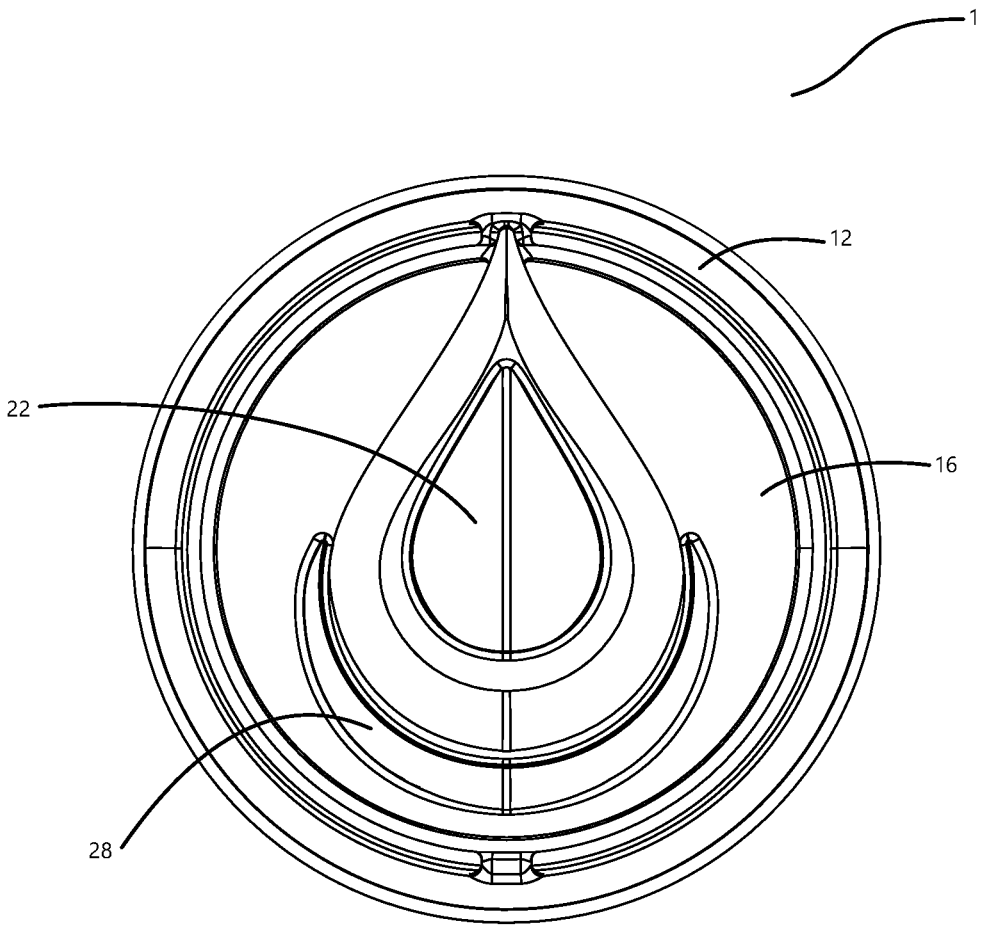
FIG. 4 is a top view of the belt buckle in accordance with the first exemplary embodiment of the present invention.
Figure 5:
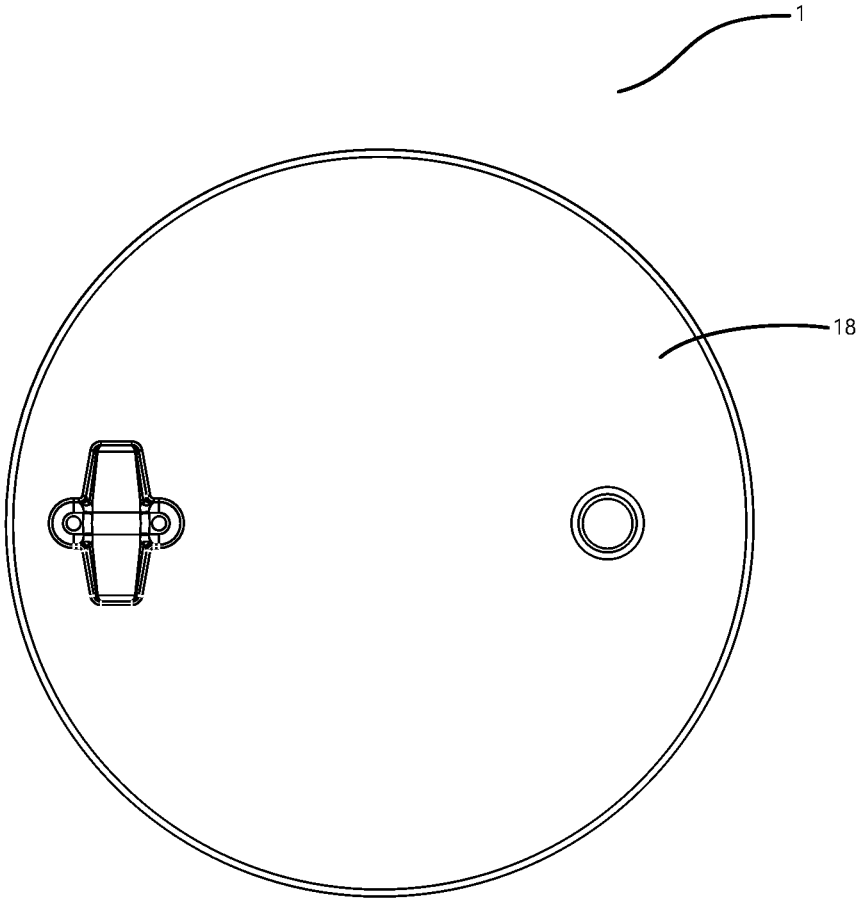
FIG. 5 is a bottom view of the belt buckle in accordance with the first exemplary embodiment of the present invention.

FIG. 1 is an exploded perspective view of a belt buckle 1 in accordance with a first exemplary embodiment of the present invention. FIG. 2 is an exploded side view of the belt buckle 1 in accordance with the first exemplary embodiment of the present invention. FIG. 3 is a sectional side view of the belt buckle 1 in accordance with the first exemplary embodiment of the present invention. FIG. 4 is a top view of the belt buckle 1 in accordance with the first exemplary embodiment of the present invention. FIG. 5 is a bottom view of the belt buckle 1 in accordance with the first exemplary embodiment of the present invention.

The belt buckle 1 includes a top cover 12, a bottom plate 14, a replaceable insert 16, and a base plate 18. The top cover 12 includes a first recess 20. The bottom plate 14 includes a first extruded portion 22 which extrudes toward the top cover 12. The replaceable insert 16 includes a second recess 24. The replaceable insert 16 may be disposed at least in part between the top cover 12 and the bottom plate 14.

As shown in FIG. 3, when the belt buckle 1 is assembled, the bottom plate 14 and the replaceable insert 16 may be disposed at least in part between the top cover 12 and the base plate 18. The first extruded portion 22 may be disposed at least in part in the second recess 24. Further, the first extruded portion 22 may be disposed at least in part in the first recess 20.

The top cover 12, the bottom plate 14, the replaceable insert 16, and/or the base plate 18 may be assembled with each other via an interference fit (e.g., a press-fit or a friction-fit). The top cover 12 is assembled with the base plate 18 via a press-fit 26, as shown in FIG. 3. Specifically, the connection of the press-fit 26 is on a rim of the top cover 12.

In some exemplary embodiments of the invention, the bottom plate 14 may include a second extruded portion 28, which extrudes toward the top cover 12. The replaceable insert 16 may include a third recess 30, and the second extruded portion 30 may be disposed at least in part in the third recess 30. The top cover 12 may include a fourth recess 32, and the second extruded portion 28 may be disposed at least in part in the fourth recess 32.

In the first exemplary embodiment shown in FIGS. 1-5, the first extruded portion 22 is of water droplet (or dome) shape and the second extruded portion 28 is of crescent shape. That is, the shape of the first extruded portion 22 is different from the shape of the second extruded portion 28. However, the shapes of extruded portions may be identical in other embodiments.

In the first exemplary embodiment shown in FIGS. 1-5, the top cover 12, the bottom plate 14, the replaceable insert 16, and the base plate 18 are of round or circular shape. However, the shapes of these components are not limited to round or circular shape. Instead, any other shape, for example, rectangular, triangular, or spherical shape can be used without departing from the spirit of the present disclosure.

As can be seen in FIGS. 1-5, one or more of the top cover 12, the bottom plate 14, the replaceable insert 16, and the base plate 18 are formed as mutually corresponding shapes to form a 3-dimensional shape of the belt buckle 1. For example, the first recess 20 of the top cover 12 and the second recess 24 of the replaceable insert 16 may be of water droplet shape that corresponds to the water droplet shape of the first extruded portion 22 of the bottom plate 14. Similarly, the third recess 30 of the replaceable insert 16 may be of crescent shape that corresponds to the crescent shape of the second extruded portion 28 of the bottom plate 14.

In some embodiments, one or more of the top cover 12, the bottom plate 14, the replaceable insert 16, and the base plate 18 can be made of, at least in part or entirely, any one of a metallic material or a non-metallic material. Metallic material can include, but is not limited to, steel, stainless steel, anodized aluminum, aluminum, titanium, magnesium, brass, and their respective alloys. Non-metallic material can include, but is not limited to, wood, ceramic, plastic, composite, carbon fiber, and nano-composite material.

In some embodiments, the top cover 12, the bottom plate 14, the replaceable insert 16, and the base plate 18 may have the same color (e.g., painted with the same color). However, in other embodiments, one or more of the top cover 12, the bottom plate 14, the replaceable insert 16, and the base plate 18 may have a different color from each other.

In some embodiments, one or more of the top cover 12, the bottom plate 14, the replaceable insert 16, and the base plate 18 can be stamped components. However, in other embodiments, one or more of these components may be formed using a variety of manufacturing techniques including, but is not limited to, die casting, forging, machining, welding, gluing, or various combinations of these techniques.

Figure 6:
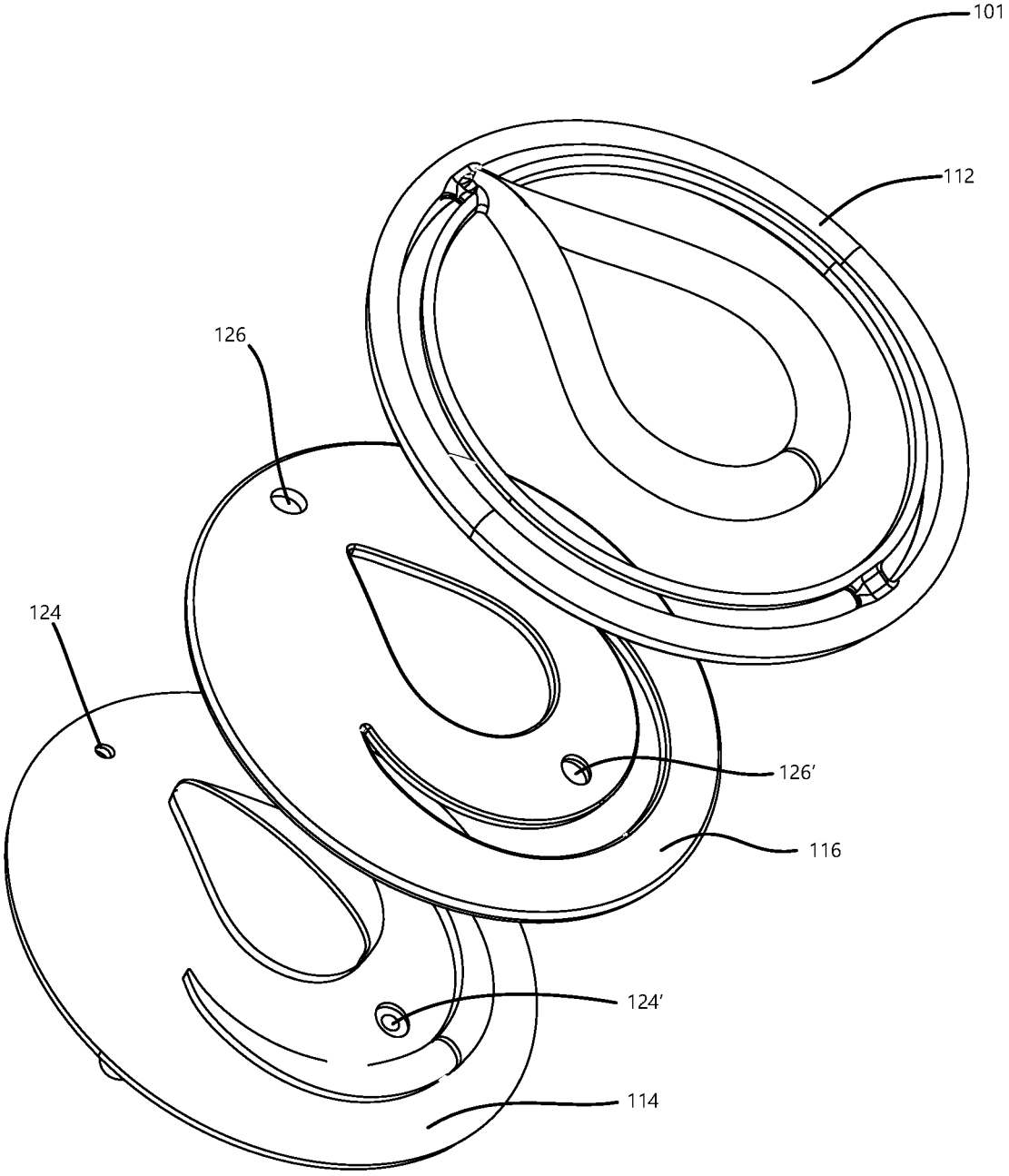
FIG. 6 is an exploded top perspective view of a belt buckle in accordance with a second exemplary embodiment of the present invention.
Figure 7:
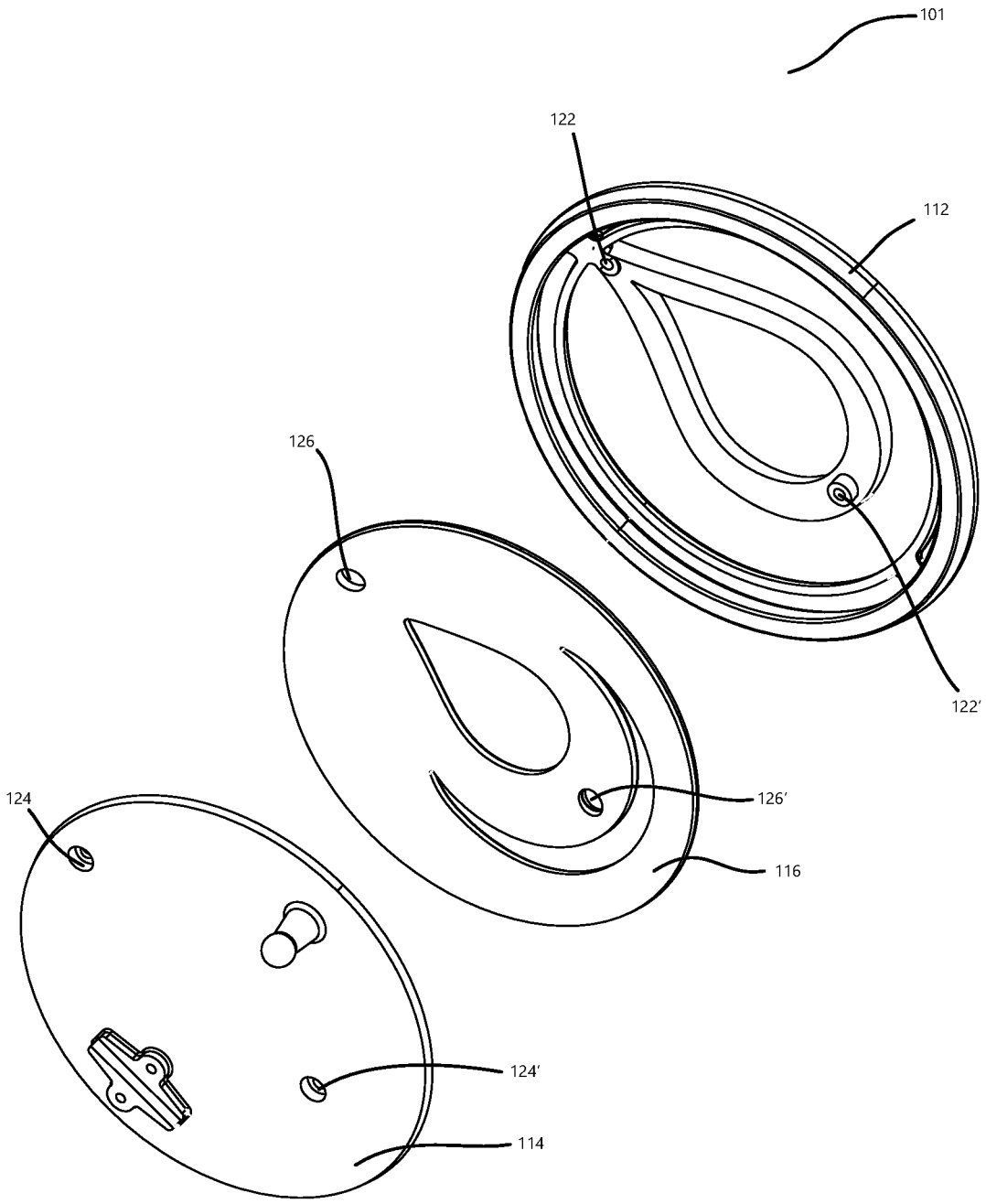
FIG. 7 is an exploded bottom perspective view of the belt buckle in accordance with the second exemplary embodiment of the present invention.

In the first exemplary embodiment shown in FIGS. 1-5, the belt buckle 1 is assembled via a press-fit 26. However, the method of assembly of the belt buckle of the present invention is not limited to such press-fit connection. Various other methods of assembly are contemplated without departing from the spirit of the present disclosure Unlike the first embodiment described above, a second exemplary embodiment employs a screw connection. FIG. 6 is an exploded top perspective view of a belt buckle 101 in accordance with a second exemplary embodiment of the present invention. FIG. 7 is an exploded bottom perspective view of the belt buckle 101 in accordance with the second exemplary embodiment of the present invention.

In the second exemplary embodiment, a top cover 112, a bottom plate 114, and a replaceable insert 116 may be substantially identical or similar as in the first exemplary embodiment. In order to provide a screw connection, the top cover 112, the bottom plate 114, and the replaceable insert 116 includes first screw holes 122, 122', second screw holes 124, 124', and third screw holes 126, 126', as shown in FIGS. 6 and 7.

The above-described replaceable insert 16, 116 can be swapped with another replaceable insert of different design and/or color. Since the belt buckle 1, 101 is assembled via a press-fit or a screw connection, users could easily swap between replaceable inserts of various designs or colors.

By way of the construction of the above-discussed belt buckle 1, 101, many benefits are achieved. First, belt buckles (or belts) of different designs or colors can be easily obtained without the need for purchasing multiple belt buckles or belts. Instead, users merely need to swap the replaceable insert 16, 116. Such replaceable inserts may be of different designs or colors. Second, swapping of the replaceable insert 16, 116 can be conveniently conducted by way of e.g., a press-fit. Third, a structurally compact and simple design, which also provides a new form of aesthetic variety is achieved.

While particular aspects and embodiments are disclosed herein, other aspects and embodiments will be apparent to those skilled in the art in view of the foregoing teaching. The various aspects and embodiments disclosed herein are for illustration purposes only and are not intended to be limiting, with the true scope and spirit being indicated by the following claims.

What is claimed is:

1. A belt buckle comprising:
a top cover including a first recess;
a bottom plate including a first extruded portion extruding toward the top cover; and
a replaceable insert including a second recess, the replaceable insert being disposed at least in part between the top cover and the bottom plate, wherein
the first extruded portion is disposed at least in part in the second recess and disposed at least in part in the first recess.

2. The belt buckle according to claim 1, further comprising:
a base plate, wherein
the bottom plate and the replaceable insert are disposed at least in part between the top cover and the base plate.

3. The belt buckle according to claim 2, wherein the top cover is assembled with the base plate via a press-fit.

4. The belt buckle according to claim 3, wherein connection of the press-fit is on a rim of the top cover.

5. The belt buckle according to claim 1, wherein
the bottom plate includes a second extruded portion extruding toward the top cover,
the replaceable insert includes a third recess, and
the second extruded portion is disposed at least in part in the third recess.

6. The belt buckle according to claim 5, wherein
the top cover includes a fourth recess, and
the second extruded portion is disposed at least in part in the fourth recess.

7. The belt buckle according to claim 5, wherein a shape of the second extruded portion is different from a shape of the first extruded portion.

8. The belt buckle according to claim 1, wherein the top cover, bottom plate, or the replaceable insert is a stamped component.

9. A belt, comprising:
a belt buckle according to claim 1.

10. A belt buckle comprising:
a top cover including a first recess;
a bottom plate including a first extruded portion extruding toward the top cover; and
a replaceable insert including a second recess, the replaceable insert being disposed at least in part between the top cover and the bottom plate, wherein
the top cover, the bottom plate, and the replaceable insert are formed as mutually corresponding shapes to form a 3-dimensional shape of the belt buckle, wherein the first extruded portion is disposed at least in part in the first recess and disposed at least in part in the second recess.

11. The belt buckle according to claim 10, further comprising:

a base plate, wherein the bottom plate and the replaceable insert are disposed at least in part between the top cover and the base plate.

12. The belt buckle according to claim 11, wherein the top cover is assembled with the base plate via a press-fit.

13. The belt buckle according to claim 12, wherein connection of the press-fit is on a rim of the top cover.

14. The belt buckle according to claim 10, wherein the bottom plate includes a second extruded portion extruding toward the top cover, the replaceable insert includes a third recess, and the second extruded portion is disposed at least in part in the third recess.

15. The belt buckle according to claim 14, wherein the top cover includes a fourth recess, and the second extruded portion is disposed at least in part in the fourth recess.

16. The belt buckle according to claim 14, wherein a shape of the second extruded portion is different from a shape of the first extruded portion.

17. The belt buckle according to claim 10, wherein the top cover, bottom plate, or the replaceable insert is a stamped component.

18. A belt, comprising:

a belt buckle according to claim 10.

* * * * *